US006234571B1

(12) United States Patent
Atkins et al.

(10) Patent No.: US 6,234,571 B1
(45) Date of Patent: May 22, 2001

(54) INDEXING SEAT FOR FOLDING CHAIR

(75) Inventors: L. E. (Tom) Atkins, Orem; David J. Laws, Provo, both of UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 09/425,850

(22) Filed: Oct. 22, 1999

(51) Int. Cl.[7] ..... A47C 4/00; A47C 3/04
(52) U.S. Cl. ..... 297/16.1; 297/239
(58) Field of Search ..... 297/16.1, 23, 55, 297/239, 452.23, 452.21

(56) References Cited

U.S. PATENT DOCUMENTS

| | | | | |
|---|---|---|---|---|
| 128,767 | | 7/1872 | Viele . | |
| 169,748 | | 11/1875 | Wakefield . | |
| 198,421 | | 12/1877 | Smith . | |
| 473,704 | | 4/1892 | Le Count . | |
| 779,327 | | 1/1905 | Stiggleman . | |
| 945,032 | | 1/1910 | Gillespie . | |
| 976,786 | | 11/1910 | Moulin . | |
| 1,591,550 | | 7/1926 | Rosenthal . | |
| 1,975,622 | | 10/1934 | Schermerhorn . | |
| 2,303,189 | | 11/1942 | Adler . | |
| 2,514,125 | | 7/1950 | Evans . | |
| 2,568,269 | | 9/1951 | Burnham et al. . | |
| 2,874,755 | | 2/1959 | Smith | 297/239 X |
| 3,031,227 | * | 4/1962 | Van Buren, Jr. | 297/239 |
| 3,087,755 | | 4/1963 | Boman | 297/239 |
| 3,220,764 | | 11/1965 | Duer . | |
| 3,531,157 | * | 9/1970 | Duckett et al. | 297/452.21 X |
| 3,639,001 | | 2/1972 | Anderson . | |
| 3,669,496 | | 6/1972 | Chisholm . | |
| 3,838,884 | * | 10/1974 | Faiks et al. | 297/239 X |
| 3,847,433 | * | 11/1974 | Acton et al. | 297/239 |
| 4,235,473 | | 11/1980 | Aginar . | |
| 4,319,779 | | 3/1982 | Leonhart . | |
| 4,978,168 | * | 12/1990 | Piretti | 297/239 X |
| 5,002,337 | * | 3/1991 | Engel et al. | 297/239 |
| 5,040,848 | | 8/1991 | Irie et al. . | |
| 5,071,191 | | 12/1991 | Leib . | |
| 5,096,259 | | 3/1992 | Stanfield | 297/239 |
| 5,383,712 | | 1/1995 | Perry | 297/239 X |
| 5,738,408 | * | 4/1998 | Wu | 297/239 |
| 5,825,095 | | 10/1998 | Albecker III . | |
| 5,860,697 | * | 1/1999 | Fewchuk | 297/239 |
| 5,863,096 | * | 1/1999 | Bartlmae | 297/239 X |
| 5,967,605 | * | 10/1999 | Stanfield | 297/239 |
| 6,030,037 | * | 2/2000 | Ritch et al. | 297/239 |
| 6,095,597 | * | 8/2000 | Huang | 297/239 X |
| 6,099,073 | * | 8/2000 | Bruschi | 297/239 X |

* cited by examiner

*Primary Examiner*—Peter M. Cuomo
*Assistant Examiner*—Rodney B. White
(74) *Attorney, Agent, or Firm*—Thorpe North & Western, LLP

(57) ABSTRACT

A folding chair has a support structure with a back support portion and leg supports. A stabilizing seat is pivotally coupled to the support structure. The seat has a seating surface, and at least one upper projecting alignment member configured to substantially engage a second chair to stabilize and prevent relative lateral movement between the two chairs when in a folded and stacked relationship.

20 Claims, 5 Drawing Sheets

INDEXING SEAT FOR FOLDING CHAIR

BACKGROUND OF THE INVENTION

1. The Field of the Invention

The present invention relates generally to a folding chair, and/or a stackable/storable folding chair system. More particularly, the present invention relates to a folding chair having a seat with a projecting alignment member, such that a number of folded chairs may be stacked adjacent one another with the projecting alignment member of the seat engaging or nesting with the support frame of an adjacent stacked chair for stability.

2. The Background Art

Folding chairs are often used in situations in which it is desirable or necessary to provide varying numbers and/or varying layouts of chairs, such as during conventions, seminars, conferences, etc. In addition, folding chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed.

It is desirable that the folding chairs be capable of being folded and stacked for storage so that the chairs take up less room when they are not required. It will be appreciated that some situations or events will require thousands of folding chairs, all of which may need to be folded and stored at any given period. Thus, the chairs must be folded and stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abutting the legs, and/or have front and back legs which fold against one another, such that the thickness of the chairs in the folded position comprises the thickness of both the front and rear legs, and/or the thickness of the legs and the seat. Another disadvantage of many conventional folding chairs is that they fold awkwardly, with bulky folded configurations and/or various protruding members.

In addition, it is desirable that the folding chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall have a potential domino effect, with all of the chairs subject to being knocked over. Other prior art folding chairs have complicated and expensive hanging rack systems. For example, a wheeled cart might have a plurality of support arms from which a plurality of folding chairs are suspended. One disadvantage of these types of systems is that chairs on the end of the hangers tend to fall off the rack, and the wheeled racks are difficult to move and maneuver.

Some types of prior art folding chairs have back rest portions which protrude from the chair and into an adjacent folding chair. For example, a folding chair may have a back portion which curves outwardly to protrude from the frame of the chair, and into the frame of and adjacent folding chair. Although this relationship allows the chairs to be stored with greater density, the chairs tend to be unstable in a stored position. The broad rounded backs of the chairs act as ramps which fail to resist movement of an adjacent chair. In addition, the chairs are still relatively thick and bulky.

It also is desirable that the chairs be easy to set up and take down, or fold and unfold. It will be appreciated that there is considerable time involved in setting up and taking down thousands of chairs. One disadvantage of many prior art folding chairs is that they are difficult to both unfold and fold. For example, most folding chairs require the person to use both hands to fold and unfold the chair. One hand usually has to grasp the back of the chair while the other hand has to grab and pivot the seat in or out.

It also is desirable that the chairs be comfortable. Typical prior art folding chairs have rigid metal seats and seat backs which can be hard and uncomfortable. One disadvantage of many prior art folding chairs is that the chairs either fold well and are uncomfortable, or are comfortable but awkward in folding. Thus, there tends to be a trade off between comfort and foldability. Some chairs provide a cushion. But these chairs still utilize the rigid metal seat bottoms and seat backs, and the cushions tend to make the chairs even thicker when folded.

In addition, it is desirable that the chair provide proper support, or be ergonomically designed. One disadvantage of many prior art chairs is that the angle between the back rest and the seat is dictated by the folding mechanism of the chair. Thus, in an effort to create a folding chair, the proper ergonomic design of the back rest and seat is often compromised in order to obtain a chair that folds more easily.

Another disadvantage of many typical prior art folding chairs is that they have a relatively small back support which may not adequately support a user's back. The small back support is often a function of the folding configuration of the chair. Again, the back support is often compromised in order to obtain a chair that folds. For example, the seat may be configured to fold upwardly or towards the back support, so that a relatively large space must exist between the back support and the seat so that the seat may fold into that space. That space is usually located where a user requires back support.

It also is desirable that the folding chair be durable. It will be appreciated that the chair will be alternately stored and used, folded and unfolded, innumerable times. Similarly, it is desirable that the folding chair be strong. The chair must be able to support persons of various weight, often in potentially abusive conditions.

It also is desirable that the folding chair be safe. It will be appreciated that as the various parts of the chair fold, there is a potential for fingers and the like to become pinched within the folding mechanisms.

Therefore, it would be advantageous to develop a folding chair capable of folding for high density storage. It also would be advantageous to develop such a folding chair which is more stable and safe in the folded and stored position. It would further be advantageous to develop a folding chair which (i) may easily be folded and unfolded; (ii) is comfortable and safe; (iii) is durable, strong, and cost effective.

OBJECTS AND SUMMARY OF THE INVENTION

It is therefore an object of the present invention to provide a folding chair which folds relatively thin to maximize storage density.

It is another object of the present invention to provide such a folding chair which stores safely and is stable when stored, and/or stacked.

It is another object of the present invention to provide a folding chair which is easily folded and unfolded.

It is yet another object of the present invention to provide a folding chair which is safe and comfortable.

It is yet another object of the present invention to provide a folding chair which is durable, strong, and cost effective.

The above objects and others not specifically recited are realized in a specific illustrative embodiment of a folding chair having a folding, stabilizing seat. The chair includes a support structure having a back support portion and leg supports. The stabilizing seat is pivotally coupled to the support structure.

The seat has a seating surface, and at least one upper projecting alignment member. The alignment member is configured to substantially engage a second chair to stabilize and prevent relative lateral movement between the two chairs when in a folded and stacked relationship.

In accordance with one aspect of the present invention, the upper projecting alignment member protrudes from a rear corner of the seat. In addition, two upper projecting alignment members may each protrude from a rear corner of the seat.

In accordance with another aspect of the present invention, the upper projecting alignment member is integrally formed with the seating surface. The integral, upper projecting alignment member protrudes substantially perpendicular to the seat surface. The integral alignment member may include a seating curvature forming a continuous extension of the seating surface.

In accordance with another aspect of the present invention, a majority of the stabilizing seat collapses into a volume defined by the support structure with the upper projecting alignment member protruding therefrom to engage another chair. The upper projecting alignment member nests with the support structure of the second adjacent and stacked chair.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
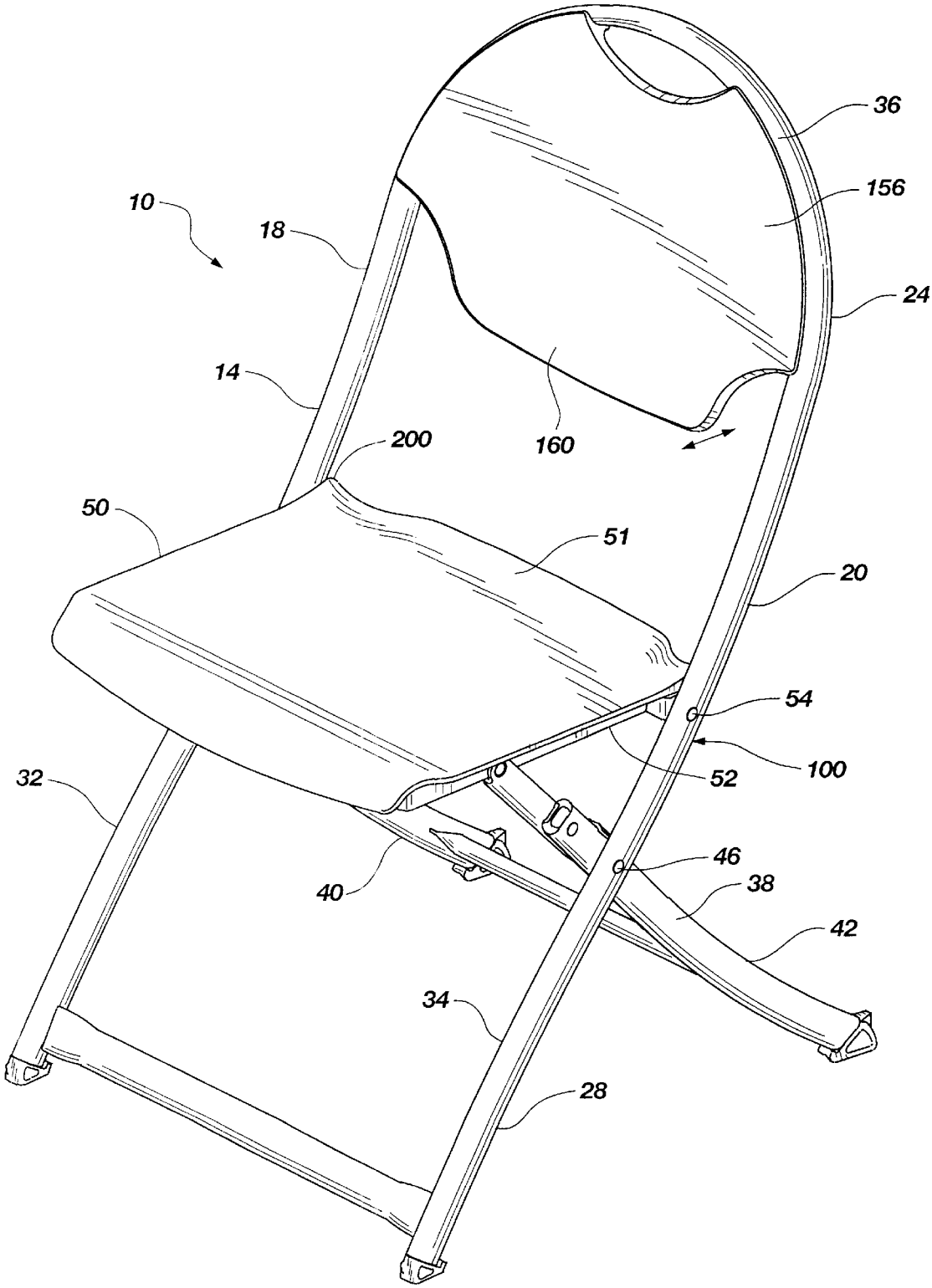
FIG. 1 is a perspective view of a preferred embodiment of a folding chair in accordance with the present invention in a first open unfolded position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

As illustrated in FIG. 1, a folding chair, indicated at 10, in accordance with the present invention, is shown in a first, open, unfolded orientation or position. The folding chair 10 advantageously has a folding, stabilizing seat 50 with an upward projecting alignment member 200 to stabilize and prevent relative lateral movement between two folded and stacked chairs, as described in greater detail below.

Figure 3:
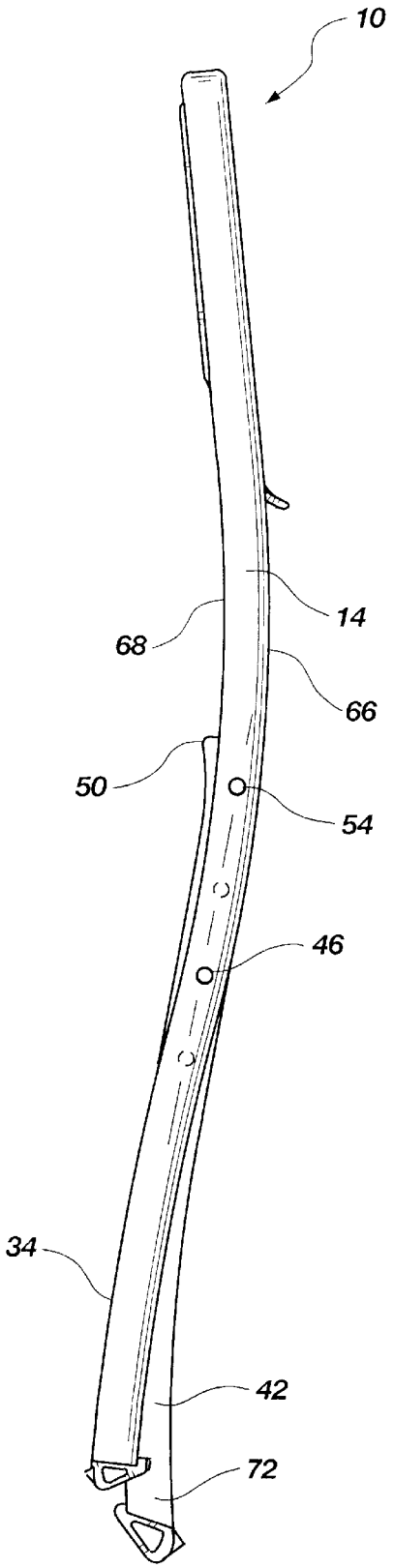
FIG. 3 is a side view of the preferred embodiment of the folding chair of the present invention in a second closed folded position.
Figure 4:
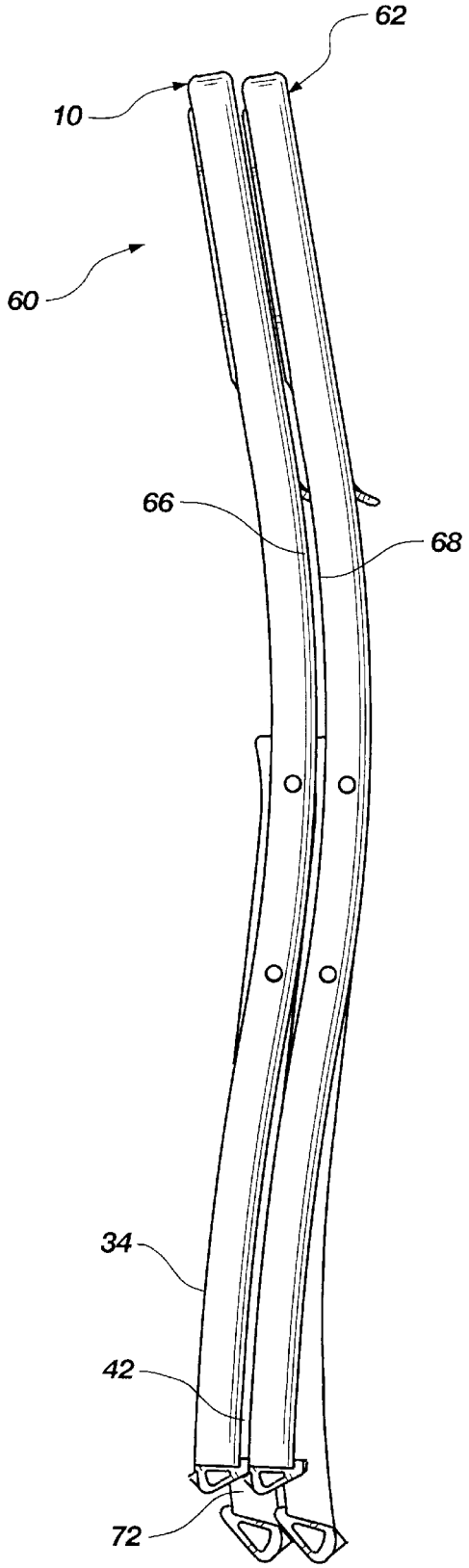
FIG. 4 is a side view of the preferred embodiment of a storable/stackable folding chair system of the present invention showing two folding chairs in the folded position which are disposed adjacent one another in a nesting or indexing relationship.

As indicated above, typical prior art chairs fold into a thick, awkward or bulky shape or configuration, or have significant protruding members, such that typical prior art folding chairs are less dense when stored, and require more space for storage. The folding chair 10 of the present invention utilizes a new approach in which the chair 10 is designed or configured to fold or collapse into a minimum thickness, such that the chairs 10 of the present invention have a very high storage density, while still providing strength, comfort, and durability. Thus, when folded, the chair 10 of the present invention advantageously is thin or presents a minimal profile, as shown in FIG. 3. In addition, the thin profile of the chair 10 advantageously is shaped or configured to facilitate nesting or indexing with adjacent chairs, as shown in FIG. 4.

The shape of the thin profile of the chair of the present invention 10 may take various configurations, as described in co-pending U.S. patent application Ser. No. 09/425,586, filed Oct. 22, 1999 which is herein incorporated by reference.

Figure 2:
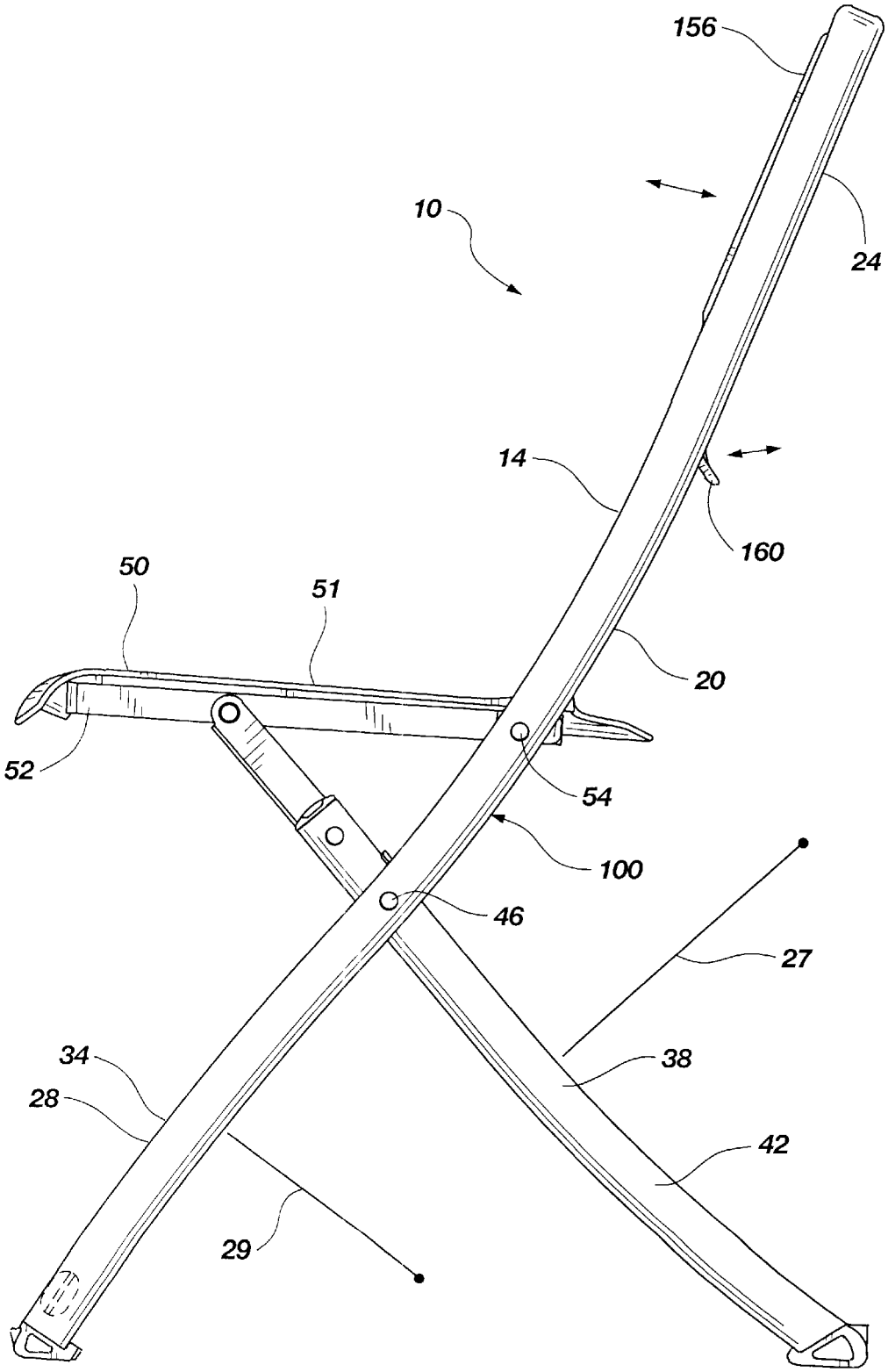
FIG. 2 is a side view of the preferred embodiment of the folding chair in accordance with the present invention in the first open unfolded position.

Referring to FIGS. 1 and 2, the folding chair 10 has a rigid support frame 14 including left and right, or first and second, rigid side supports 18 and 20, as shown in FIG. 1. As indicated above, it is desirable that the chair 10 be durable and strong. Thus, the rigid nature of the support frame 14 increases the durability and strength of the chair 10.

Preferably, the support frame 14 is formed from a tubular material to optimize strength and weight. In addition, the tubular material preferably has an elongated cross-sectional shape which is oriented generally vertically to increase the weight capacity of the chair 10. Furthermore, the tubular material preferably has rounded corners, or most preferably has an oval cross-sectional shape, giving soft edges to the frame 14 which are more comfortable.

The support frame 14, and side supports 18 and 20, have an upper back support portion 24 forming the back of the chair 101 and a lower front leg portion 28 formed integrally and continuously with the upper back support portion 24.

The back support portion 24 extends forwardly from the back of the chair 10 to the lower front leg portions 28. Thus, the first and second side supports 18 and 20, or the upper and lower portions 24 and 28 thereof, are unitary, integral, and rigid structures to increase strength and durability. The front leg portion 28 preferably includes left and right, or first and second, front legs 32 and 34. In addition, the support frame 14, or side supports 18 and 20, may be a single integral member with a broad curved back member 36 formed at the tops of the side supports 18 and 20, as shown.

As indicated above, the rigid support frame 14 preferably is shaped to form a curved spline profile. As used herein, the term "curved spline" is used broadly to describe an elongated member with at least a curved portion, and which may include multiple curves and/or straight portions as well. The profile is an elongated continuous profile having a substantially uniform thickness which is relatively thin when all elements are collapsed within the profile. The thin uniform profile contributes to a higher storage density of the chairs.

The chair 10 also includes a rear leg portion 38, which preferably includes left and right, or first and second, rear legs 40 and 42, as shown in FIG. 1. The rear leg portion 38, or rear legs 40 and 42, are pivotally coupled to the support frame 14 at leg pivot points 46. The leg pivot points 46 are preferably fixed pivot points, such that the rear legs 40 and 42 pivot with respect to the support frame 14 or front legs 32 and 34.

In addition, the chair 10 includes a seat or seat portion 50 pivotally coupled to the support frame 14, and between the side supports 18 and 20 at seat pivot points 54. Again, the seat pivot points 54 are preferably fixed pivot points such that the seat 50 pivots with respect to the support frame 14, rather than sliding. The seat 50 and rear legs 40 and 42 also are pivotally connected as discussed in greater detail below.

The seat 50 may comprise a seating surface 51 secured to a seat frame 52. The seat frame 52 may extend generally around the perimeter of the seat 50, or along the sides, front and back of the seat 50. This provides an advantage where the seat may flex in response to a load, as discussed below. The seating surface 51 is disposed on the seat frame 52, and spans the distance between the perimeter of the frame 52. Preferably, the seating surface 51 is formed of a flexible material, and flexes, bends, or deflects downwardly and into the seat frame 52 in response to, and proportional to, a user's weight. The flexibility of the seating surface 51 is enabled because of the perimeter location of the seat frame 52, and allows the seating surface 51 to cup or curve, and thus conform to the user for a custom fit. In addition, the seating surface 51 preferably is coupled to the seat frame 52 only at the front and back, and not at the sides, to further allow the seat surface 51 to deflect.

The seat 50 and rear legs 40 and 42 pivot with respect to the support frame 14 between (i) the first, open, unfolded position, as shown in FIGS. 1 and 2, and (ii) the second, closed, folded position, as shown in FIG. 3. The leg pivot points 46 preferably are located on a straight section of the support frame 14, or first and second side supports 18 and 20, or at a mid-section of the composite curve. Thus, holes for the pivot points 46 may be formed in the side supports 18 and 20 prior to bending the support frame 14 during the manufacturing process. If the holes are located on curved portions of the support frame 14, then forming the holes prior to bending may cause the holes to be mis-shaped as the curve portion of the support frame is formed.

The location of leg pivot points 46 facilitates a chair having a curved spline. By locating the pivot points 46 at the mid-section of a composite curve, or at the intersection of two linear members, the relative shear and load stresses (combined stresses), as well as the strain, in the frame 14 are at a minimum. The stress is high at the leg pivot points 46 because the real legs 40 and 42 act as lever arms to concentrate the force.

Referring to FIG. 3, the seat 50 and rear legs 40 and 42 advantageously pivot such that a majority of the seat 50 and a majority of the rear legs 40 and 42 collapse within a volume defined by the support frame 14. Thus, in the folded position, the chair 10 substantially maintains the curved spline profile of the support frame 14. The chair 10 (or the support frame 14, seat 50 and rear legs 40 and 42) also advantageously has a curved spline profile in the closed position, with the profile having a substantially uniform thickness which is relatively thin. The volume defined by the support frame 14 is the space between the side supports 18 and 20. Thus, the seat 50 and rear legs 40 and 42 pivot such that a majority of the seat 50 and rear legs 40 and 42 fold directly between the side supports 18 and 20.

The seat 50 and rear legs 40 and 42 collapsing within the volume of the frame 14 provides a distinct advantage over prior art folding chairs, in which the seat and legs fold inwardly and onto the frame such that the frame, legs and seat form a relatively thick stack. In addition, the curved spline profile of the chair 10 in the folded position provides a distinct advantage over the prior art chairs, in which the profiles are straight and/or bulky. The chairs 10 of the present invention are capable of not only folding into a relatively thin profile in order to save storage space, but also forming a continuously and similarly shaped profile in which the profiles of adjacent chairs may be matched or nested to increase stability of the chairs in a stacked and stored relationship.

As illustrated in FIG. 4, a storable folding chair system, indicated generally at 60, may include a plurality of the above described chairs, including, for example, a first chair 10 and a second chair 62. The curved spline profile of the first folded chair 10 nests or indexes with the curved spline profile of the second folded chair 62 to resist relative motion of the two chairs 10 and 62 when disposed adjacent one another in an adjacent storage relationship. Referring again to FIG. 3, the curvature of the profile creates a protrusion or protruding portion 66 of the profile and an opposite matching indentation or recess 68 in the profile as the profile deviates from a straight line into a curvature. Thus, referring to FIG. 4, the protrusion 66 of the profile of the first chair 10 nests or indexes within the indentation or recess 68 of the profile of the second chair 62. Unlike many prior art folding chairs, which include a backrest portion which protrudes from the straight thick profile of the chair into the straight thick profile of an adjacent chair, the entire profile of the chair 10 of the present invention simultaneously forms the protrusions 66 and indentations 68 such that it is the entire profile of the chairs 10 and 62 which match to nest.

Referring again to FIGS. 1 and 2, the front legs 32 and 34 are preferably curved, and may be convex, as shown. The rear legs 40 and 42 are advantageously similarly curved so that the rear legs 40 and 42 may substantially collapse within the volume defined by the front legs 32 and 34. Both the front and rear legs 28 and 38 have a radius of curvature, with the radius of curvature 27 of the rear legs 40 and 42 being smaller than the radius of curvature 29 of the front legs 32 and 34. The smaller radius of curvature 27 of the rear legs 40 and 42 allows a greater portion of the rear legs 40 and 42 to collapse within the volume defined by the front legs 32 and 34.

Referring to FIG. 3, the smaller radius of curvature of the rear legs 40 and 42 also allows a portion of the bottom ends 72 of the rear legs 40 and 42 to protrude or extend outside the volume defined by the front legs 32 and 34. Although it is desirable to have a majority of the seat 50 and rear legs 40 and 42 collapse within the profile of the frame 14, the bottom ends 72 of the rear legs 40 and 42 extend outside of the volume of the front legs 32 and 34 to increase the stability of multiple stacked chairs. Referring to FIG. 4, it can be seen that the bottom ends 72 of the rear legs 42 of the first chair 10 protrude slightly from the profile, specifically of the front legs 34, of the first chair 10, and into the profile of the second chair 62. Therefore, the curved spline profile of the chairs 10 and 62 resists relative movement between the two chairs 10 and 62 in a longitudinal direction (or top to bottom direction), and the bottom end 72 of the first chair 10 protruding into the profile of the second chair 62 resists lateral relative motion (side-to-side) between the two chairs 10 and 62.

The folding chair 10 also includes left and right, or first and second folding systems, represented by the second or right folding system 100, formed by and pivotally coupling the frame 14, seat 50 and respective first and second rear legs 40 and 42 together, as described in co-pending U.S. patent application Ser. Nos. 09/425,580, filed Oct. 22, 1999, entitled "FOLDING MECHANISM FOR FOLDING CHAIR", and 09/425,577, filed Oct. 22, 1999, entitled "FOLDING MECHANISM WITH KICK-OUT TAB FOR FOLDING CHAIR", which are herein incorporated by reference. The folding system 100 allows the various components of the chair 10 to fold as thinly as possible in the folded position, and provides strength to the seat in the open position.

In addition, the folding chair 10 includes a flexible back support 156 coupled to the upper back support portion 24 of the support frame 14, and a lower lumbar region or member 160, as described in co-pending U.S. patent application Ser. No. 09/425,596, filed Oct. 22, 1999, entitled "FOLDING CHAIR WITH LUMBAR SUPPORT AND FLEXIBLE BACK SUPPORT", which is herein incorporated by reference.

Figure 5:
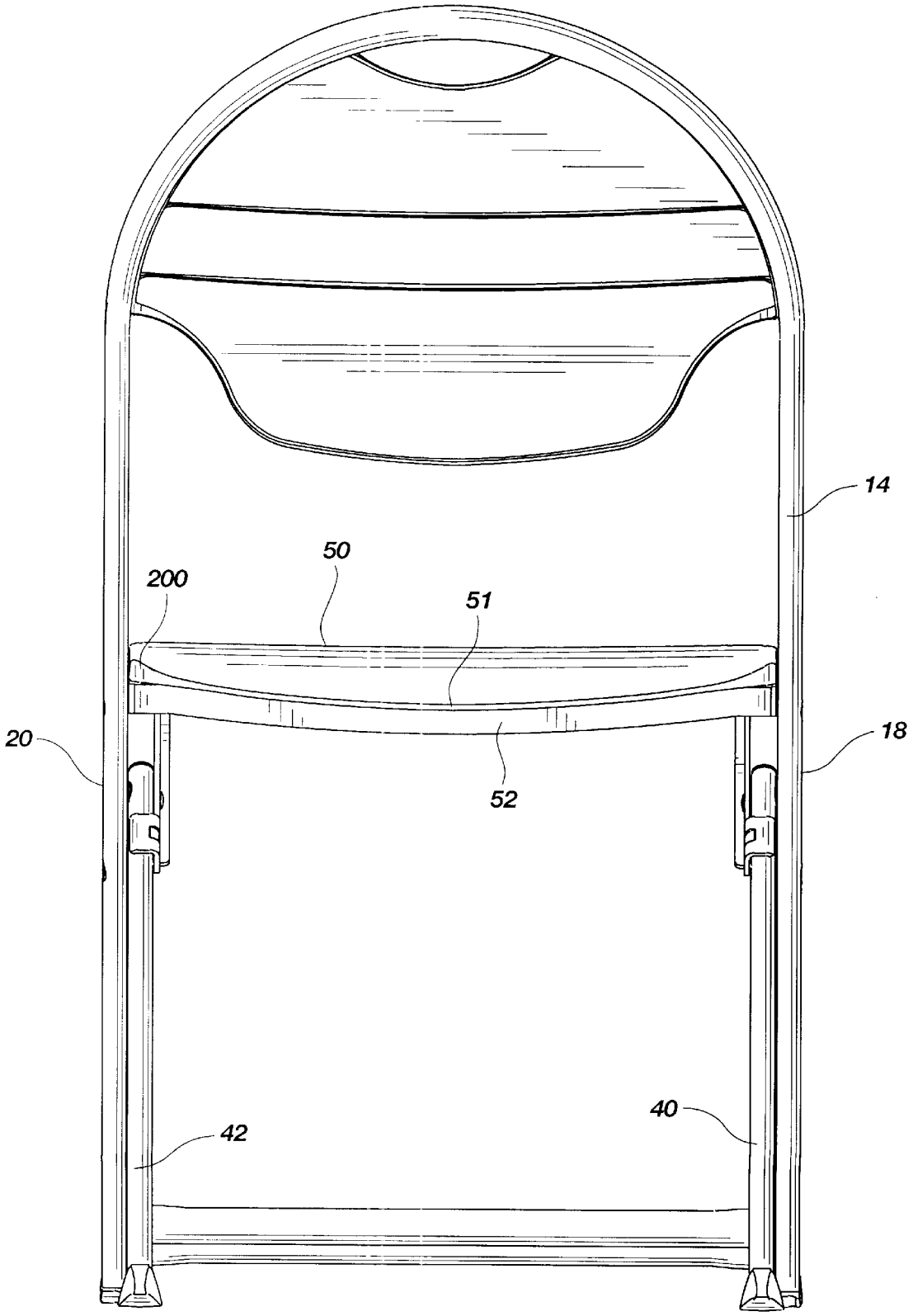
FIG. 5 is a rear view of the preferred embodiment of the folding chair in accordance with the present invention.

As described above and illustrated in FIG. 4, the stackable/storable folding chair system 60 of the present invention includes a plurality of folding chairs 10 and 62 of similar geometry with profiles that nest to prevent relative movement in at least one direction. Referring to FIGS. 1 and 5, the folding chair 10 has an upward projecting alignment member 200 associated with the seat 50 or seat surface 51. The alignment members 200 preferably are formed in the rear corners of the seat surface 51, and extend or protrude generally perpendicular to the seat surface 51. Referring to FIG. 5, the seat surface 51 and seat structure 52 may be broadly concave for a comfortable contour. The alignment members 200 may be formed flush with the upward surface of the seat surface 51, and continue the concave curvature of the seat surface 51 to project upwardly at the sides of the seat 50 and at the back. Thus, the curvature of the alignment members also adds to the contour and comfort of the seat 50.

Figure 6:
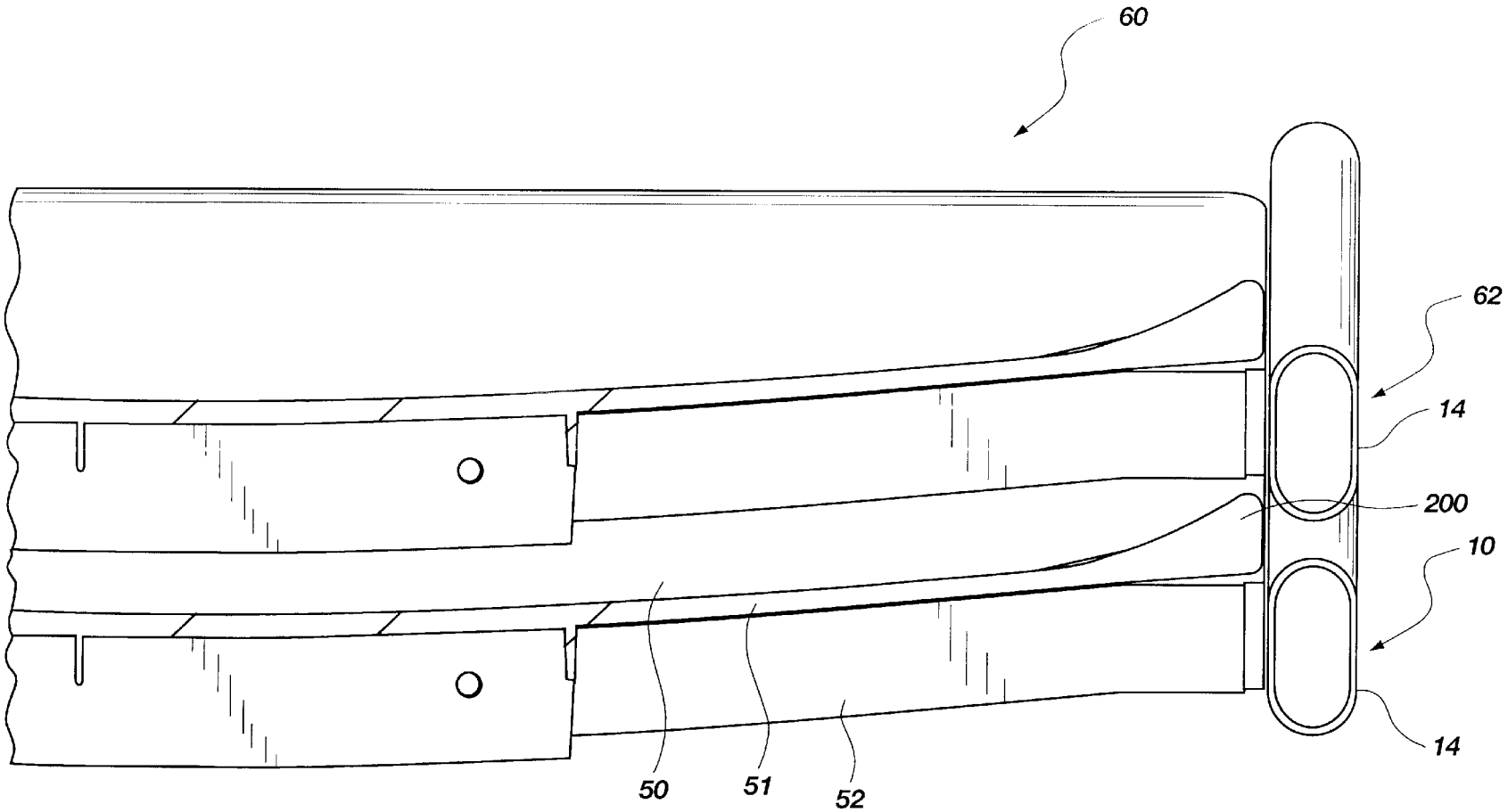
FIG. 6 is a partial cross sectional view of the preferred embodiment of the storable/stackable folding chair system of the present invention showing two folding chairs in the folded position which are disposed adjacent one another in a nesting or indexing relationship.

Referring now to FIG. 6, the alignment member 200 is shaped, sized and located to substantially engage an adjacent stacked chair 62 to stabilize the chairs 10 and 62 relative to one another, and to resist relative lateral movement between the two chairs 10 and 62. Thus, although the seat 50 substantially collapses within the volume defined by the frame 14, the alignment members 200 protrude or project upwardly from the volume defined by the first chair 10 to extend into the volume defined by the support frame 14 of the second chair 62, and for engaging the support frame of the second chair. Thus, the alignment members 200 provide the dual purpose of adding to the comfortable contour of the seat surface 51, and stabilizing adjacent stacked chairs.

In addition, while the profile of the chairs 10 and 62 resist longitudinal, or up and down, relative motion between the chairs, and the projecting lower end 72 of the rear legs 40 and 42 resist lateral, or left and right, relative motion, the alignment members 200 of the seat 50 further resist lateral, or side to side, relative movement of the chairs 10 and 62 near a mid-section of the chairs. Thus, the lower protruding end 72 of the rear legs 40 and 42 and the alignment members 200 of the seat 50 combine to create multiple points of stability along the adjacent stacked chairs. Alone, the protruding lower portion 72 of the rear legs 40 and 42 resist lateral relative motion at the bottom of the adjacent stacked chairs, while the tops may tend to displace laterally, resulting in a pivotal or rotational movement between the chairs. Similarly, the alignment members 200 of the seat 50 prevent lateral relative movement at a mid-section of the chairs alone, although the upper and lower ends may tend to move, resulting in a pivotal or rotational movement. Thus, the protruding lower end 72 of the rear legs 40 and 42 and the alignment members 200 of the seat 50 together resist both lateral and rotational movement.

In addition, the folding chair 10 may include front and rear indexing feet 210 and 214, as described in co-pending U.S. patent application Ser. No. 09/425,264, filed Oct. 22, 1999, entitled "INDEXING FEET FOR FOLDING CHAIR", which is herein incorporated by reference.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding chair comprising:

a support structure having a back support portion and leg supports; and a stabilizing seat, pivotally coupled to the support structure, and having a seating surface and at least one projecting alignment member projecting from the seat configured to substantially engage a second chair to stabilize and prevent relative lateral movement between the two chairs when in a folded and stacked relationship.

2. The folding chair of claim 1, wherein the at least one projecting alignment member protrudes from a rear corner of the seat.

3. The folding chair of claim 1, wherein the stabilizing seat includes two projecting alignment members each protruding from a rear corner of the seat.

4. The folding chair of claim 1, wherein the at least one projecting alignment member is integrally formed with the seating surface, and protrudes substantially perpendicular to the seating surface, said alignment member including a seating curvature forming a continuous extension of the seating surface.

5. The folding chair of claim 1, wherein a majority of the stabilizing seat collapses into a volume defined by the support structure with the at least one projecting alignment member protruding therefrom.

6. The folding chair of claim 1, wherein the at least one projecting alignment member is configured to nest within a support structure of a second adjacent and stacked chair.

7. A folding, stabilizing seat comprising:

a seating surface configured for pivotally coupling to a first folding chair; and at least one projecting alignment member integrally formed with the seating surface, the at least one projecting alignment member configured to substantially engage a second adjacent folded and stacked chair of common geometry to stabilize and prevent lateral movement between the first and second chairs.

8. The folding chair of claim 7, wherein the support structure is shaped to form a curved spline profile.

9. The folding, stabilizing seat of claim 7, wherein the at least one projecting alignment member protrudes from a rear corner of the seat.

10. The folding, stabilizing seat of claim 7, wherein the stabilizing seat includes two projecting alignment members each protruding from a rear corner of the seat.

11. The folding, stabilizing seat of claim 7, wherein the at least one projecting alignment member protrudes substantially perpendicular to the seating surface, said alignment member including a seating curvature forming a continuous extension of the seating surface.

12. The folding, stabilizing seat of claim 7, wherein a majority of the stabilizing seat collapses into a volume defined by the support structure with the at least one projecting alignment member protruding therefrom.

13. The folding, stabilizing seat of claim 7, wherein the at least one projecting alignment member is configured to nest within a support structure of a second adjacent and stacked chair.

14. A folding chair system comprising:

a first folding chair having a support frame, a back support, and a stabilizing seat, the stabilizing seat having a seating surface and at least one projecting alignment member protecting from the seating surface; and a second folding chair having a support frame, a back support, and a stabilizing seat such that the at least one projecting alignment member of the first folding chair substantially engages the support frame of the second folding chair when the first and second folding chairs are folded and stacked to prevent lateral movement between the first and second folding chairs.

15. The folding chair system of claim 14, wherein the projecting alignment member protrudes from a rear corner of the seat.

16. The folding chair system of claim 14, wherein the stabilizing seats includes two projecting alignment members each protruding from rear corners of the seats.

17. The folding chair system of claim 14, wherein the upper projecting alignment member is integrally formed with the seating surface, and protrudes substantially perpendicular to the seating surface, the alignment member including seating curvature forming a continuous extension of the seating surface.

18. The folding chair system of claim 14, wherein a majority of each of the stabilizing seats collapses into a volume defined by the respective support structures with the upper projecting alignment member protruding therefrom.

19. The folding chair system of claim 14, wherein the projecting alignment member of the first chair nests with the support structure of the second chair.

20. The folding chair of claim 1, wherein the support structure is shaped to form a curved spline profile.

* * * * *